US007293541B2

(12) United States Patent
Nishikawa et al.

(10) Patent No.: US 7,293,541 B2
(45) Date of Patent: Nov. 13, 2007

(54) COMBUSTION-TYPE POWER TOOL HAVING IGNITION PROOF ARRANGEMENT

(75) Inventors: Tomomasa Nishikawa, Hitachinaka (JP); Haruhisa Fujisawa, Hitachinaka (JP); Shinki Ohtsu, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/356,105

(22) Filed: Feb. 17, 2006

(65) Prior Publication Data

US 2006/0185629 A1 Aug. 24, 2006

(30) Foreign Application Priority Data

Feb. 18, 2005 (JP) ..... P2005-043277

(51) Int. Cl.
*B25C 1/08* (2006.01)

(52) U.S. Cl. ..... 123/169 G; 123/169 EL; 123/46 H

(58) Field of Classification Search ..... 123/169 EL, 123/169 G, 46 R, 46 H
See application file for complete search history.

(56) References Cited

U.S. PATENT DOCUMENTS 4,522,162 A 6/1985 Nikolich
5,197,646 A 3/1993 Nikolich
5,373,214 A * 12/1994 McCready ..... 313/142
5,408,961 A * 4/1995 Smith ..... 123/169 R
5,598,816 A * 2/1997 Pedersen ..... 123/169 EL
6,495,948 B1 * 12/2002 Garrett, III ..... 313/141
6,611,084 B2 * 8/2003 Teramura et al. ..... 313/141
6,783,047 B2 * 8/2004 Granacher ..... 227/10

FOREIGN PATENT DOCUMENTS

JP 03-025307 2/1991
JP 07-036985 2/1995

* cited by examiner

*Primary Examiner*—Stephen K. Cronin
*Assistant Examiner*—Jason Benton
(74) *Attorney, Agent, or Firm*—Antonelli, Terry, Stout & Kraus, LLP.

(57) ABSTRACT

A spark is shot between an ignition point of an ignition plug and an ignition ground. The spark is shot from an acute corner of a core of the ignition plug. A tip end of the core has an acute angle of not more than 45 degrees. With this arrangement, an emitting point of the spark can be concentrated to the tip end of the core. In order to reduce a thermal capacity of the ignition ground so as to enhance ignitability, a side opposite to the spark seating face of the ignition ground is tapered to provide an angle. Further, the ignition ground has an apex end providing an angle which is not more than 45 degrees. Because of the apex portion, thermal capacity of the ignition ground can be reduced and an acute angle can be realized to concentrate spark receiving point at the apex portion. As a result, ignitability can be enhanced.

21 Claims, 7 Drawing Sheets

COMBUSTION-TYPE POWER TOOL HAVING IGNITION PROOF ARRANGEMENT

BACKGROUND OF THE INVENTION

The present invention relates to a combustion-type power tool, and more particularly, to such power tool capable of driving a fastener of driving such as a nail, an anchor, and a staple into a workpiece by igniting a mixture of air and gaseous fuel, which in turn causes a linear momentum of a piston.

U.S. Pat. Nos. 5,197,646 and 4,522,162 disclose a combustion type power tool having a combustion chamber arrangement in which motive power of a piston is generated upon ignition of air-fuel mixture to drive a fastener such as a nail and a rivet into a workpiece.

The power tool generally includes a housing frame, a head cover, a combustion chamber frame, a cylinder, a piston, and a driver blade. The head cover is positioned at one end of the housing frame. The combustion chamber frame is reciprocally movable and abuttable on the head cover. The cylinder is disposed in the housing frame. The piston is reciprocally movable within the cylinder. The driver blade is attached to the piston to drive the fastener by the movement of the piston. A sealed combustion chamber is defined by the head cover, combustion chamber frame, cylinder, and piston when the combustion chamber frame is in abutment with the head cover. A gas canister accumulating therein a combustible fuel is provided in the housing frame. An ignition plug is provided to generate a spark for igniting air-fuel mixture when the fuel is injected and vaporized in the combustion chamber. Upon explosive combustion, the piston is rapidly moved to move the driver blade so that the fastener is driven into the workpiece.

SUMMARY OF THE INVENTION

In the conventional combustion type power tools, ignition trouble may occur in spite of the spark as a result of manipulation to a trigger. Thus, undesirable fastener driving work may result.

It is therefore an object of the present invention to provide a combustion type power tool having sufficient ignitability without any defective ignition.

This and other object of the present invention will be attained by a combustion-type power tool including a housing, a cylinder, a piston, a combustion chamber frame, a fan, and an ignition unit.

The housing has one end. The cylinder head is disposed at the one end and formed with a fuel injection passage. The cylinder is disposed in and fixed to the housing. The cylinder defines an axial direction. The piston is slidably disposed in the cylinder and reciprocally movable in the axial direction. The combustion chamber frame is disposed in the housing and movable in the axial direction. The combustion chamber frame is abuttable on the cylinder head to provide a combustion chamber in cooperation with the cylinder head and the piston. The fan is rotatably disposed in the combustion chamber for agitating and mixing an air with a combustible gas injected into the combustion chamber through the fuel injection passage. The ignition unit includes an ignition plug and an ignition ground. The ignition plug is exposed to the combustion chamber and has a tapered tip end portion providing an acute angle of less than or equal to 45 degree. The ignition ground generates a spark between the ignition plug and the ignition ground to ignite a mixture of air and the combustible gas, to thus provide a fire.

In another aspect of the invention, there is provided an ignition arrangement in a combustion type power tool in which a fan is provided in a combustion chamber defined by a cylinder head, a movable combustion chamber frame, a cylinder and a piston, a motive power of the piston being generated upon combustion of a mixture of air and a combustible gas in the combustion chamber. The ignition arrangement includes an ignition plug and an ignition ground. The ignition plug is exposed to the combustion chamber and has a tapered tip end portion providing an acute angle of less than or equal to 45 degree. The ignition ground is disposed in the combustion chamber and generates a spark between the ignition plug and the ignition ground to ignite the mixture to thus provide a fire.

In another aspect of the invention, there is provided a combustion-type power tool including a housing, a combustion chamber, and an ignition unit. The housing defines an outer frame. The combustion chamber is provided in the housing. The ignition unit includes an ignition plug exposed to the combustion chamber and has a tapered tip end portion providing an acute angle of less than or equal to 45 degrees.

DETAILED DESCRIPTION OF THE PREFERRED EMBODIMENTS

A combustion-type power tool according to an embodiment of the invention will be described with reference to FIGS. 1 through 8. The embodiment pertains to a combustion-type nail driver. In the following description, the terms "upper", "lower", "above", "below", "upward", "downward" and the like will be used assuming that the combustion-type nail driver is disposed in an orientation in which a nail is fired vertically downward.

Figure 1:
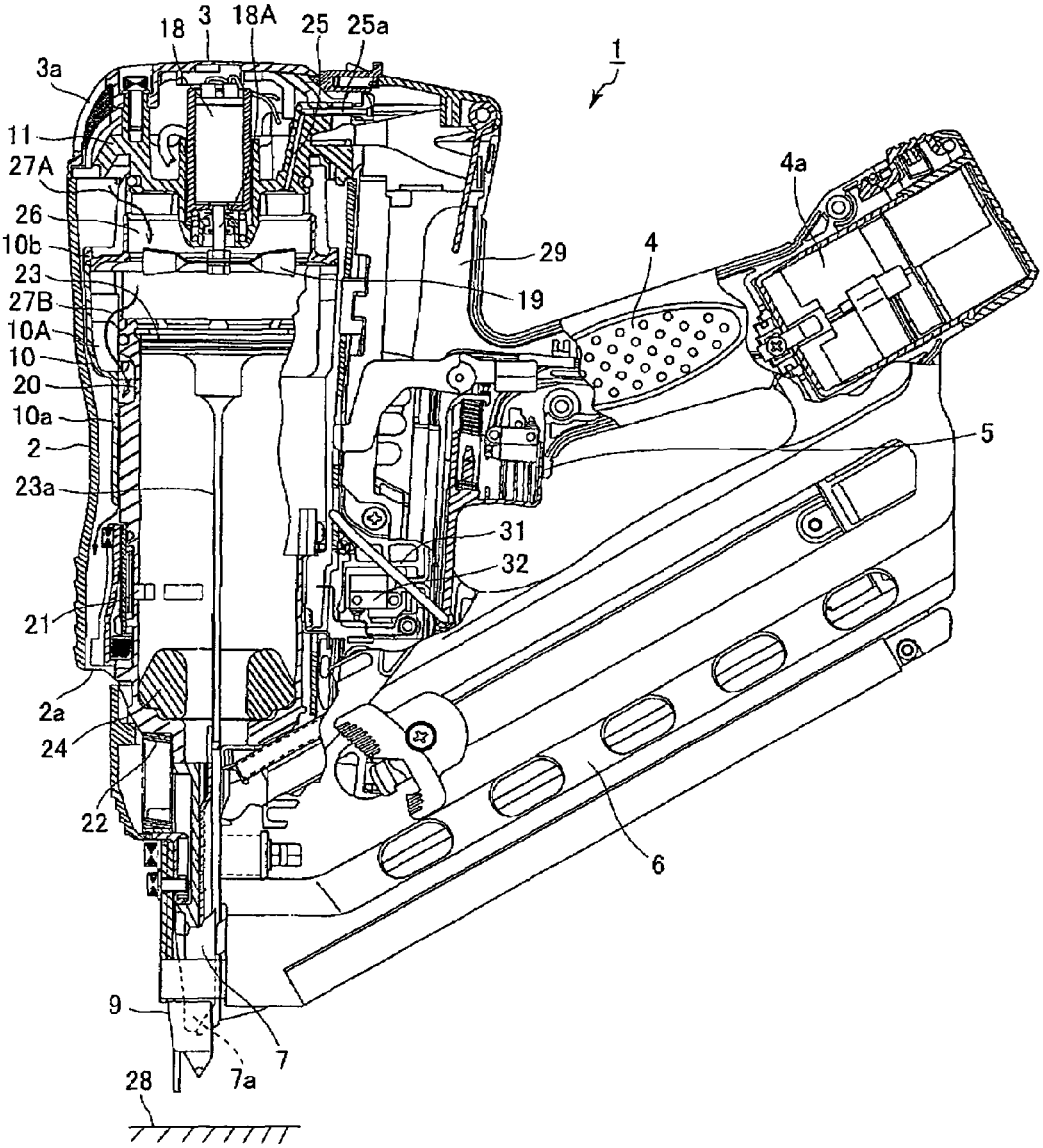
FIG. 1 is a schematic side view partly cross-sectioned showing a combustion-type power tool and shows an initial state prior to fastener driving operation.

The combustion-type nail driver 1 shown in FIG. 1 has a housing 2 constituting an outer frame. A head cover 3 formed with an intake port 3*a* is mounted on the top of the housing 2. A handle 4 extends from one side of the housing 2. The handle 4 has a trigger switch 5 and detachably accommodates therein a battery pack 4*a*. The combustion-type nail driver 1 also has a canister housing 29 at one side of the housing 2 from which the handle 4 extends. A gas canister 30 (see FIG. 3) containing therein a combustible liquidized gas is detachably installable in the canister housing 29. A magazine 6 accommodating therein a bundle of nails (not shown) is disposed below the handle 4.

A nose 7 extends from near the lower end of the housing 2. The nose 7 is integral with a cylinder 20 described later and has a tip end abuttable on a workpiece 28. The nose 7 is adapted for guiding sliding movement of a driver blade 23*a* described later and for guiding the nail driven into the workpiece 28. A push lever 9 is reciprocally slidingly movably supported to the nose 7, and projects from the tip end 7*a* of the nose 7.

Figure 2:
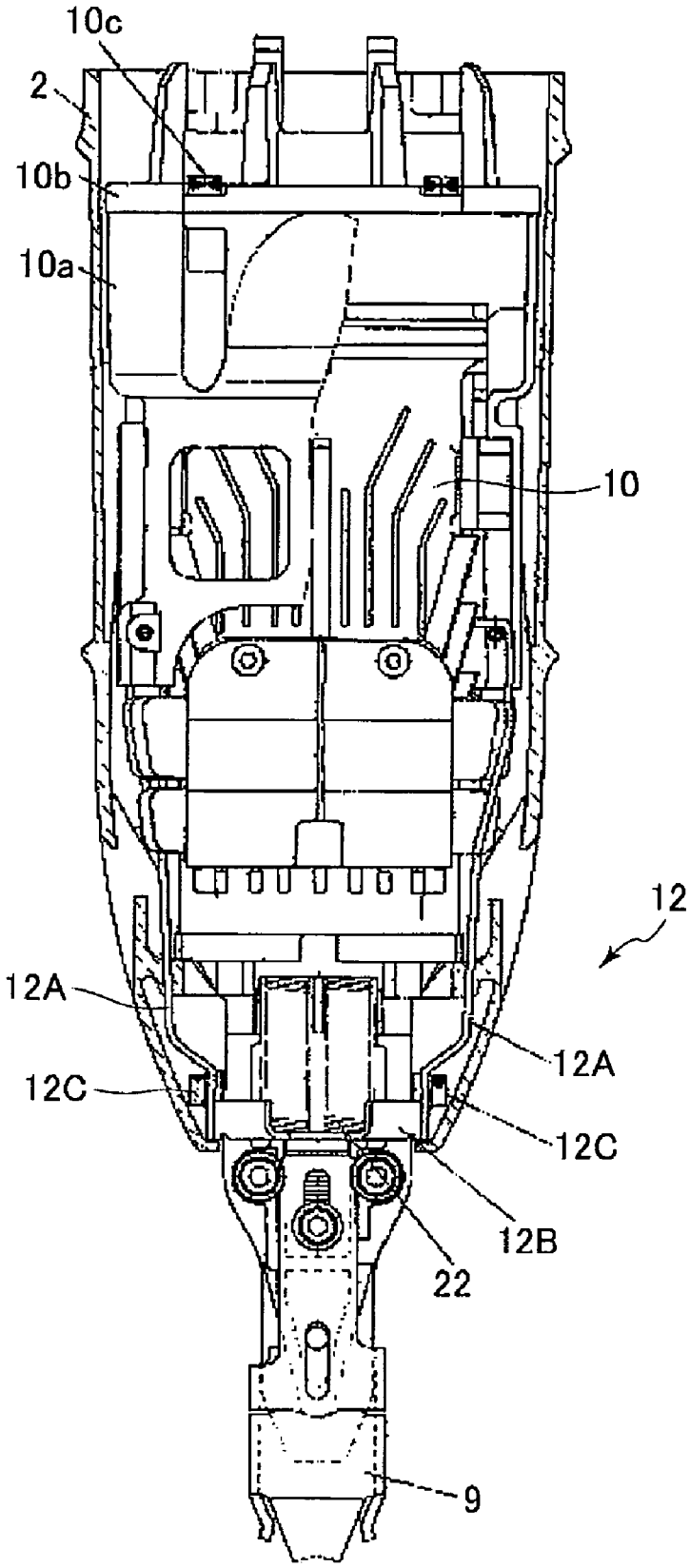
FIG. 2 is a schematic side view partly cross-sectioned showing a combustion-type power tool as viewed from the left side in FIG. 1.

As shown in FIG. 2, the push lever 9 has an upper end in association with or abuttable on a connection unit 12 fixed to a combustion-chamber frame 10 described later. The connection unit 12 includes a pair of arm sections 12A each having stepwise bending portions, and a connector section 12B having a generally rectangular shape. Each upper end of each arm section 12A is bent into L-shape and fixed to the combustion-chamber frame 10. Each lower end of each arm section 12A is fixed to the connector section 12B by means of screws 12C. The connector section 12B has major sides each provided with an upstanding piece at each end portion of the major side. Each upstanding piece is formed with a thread hole with which each screw 12C is threadingly engageable. Each upstanding piece is bent at an angle of substantially 90 degrees at each major side, so that two bent upstanding pieces are in confronting relation to each other. The connector section 12B has a flat area beside the upstanding pieces. The flat area serves as a spring seat.

A compression coil spring 22 is interposed between the connector section 12B and the cylinder 20 for normally urging the push lever 9 in a protruding direction from the housing 2. When the housing 2 is pressed toward a workpiece 28 while the push lever 9 is in abutment with the workpiece against a biasing force of the compression coil spring 22, an upper portion of the push lever 9 is retractable into the housing 2.

A cylinder head 11 is fixedly secured to the top of the housing 2 and substantially covers the open top end of the housing 2. A motor 18 is disposed at one side of the cylinder head 11 opposite the combustion chamber 26 as will be described later. An ignition plug 50 (see FIG. 5) is disposed in the vicinity of the motor 18 and the ignition position is directed toward the combustion chamber 26.

A switch container 31 is provided in the lower side of the canister housing 29. A switch 32 is contained the switch container 31 for detecting an uppermost stroke end position of the combustion-chamber frame 10 described later when the nail driver 1 is pressed against the workpiece 28. Thus, the switch 32 can be turned ON when the push lever 9 is elevated to a predetermined position for starting rotation of the motor 18.

The cylinder head 11 has a handle side in which is formed a fuel ejection passage 25 which allows a combustible gas to pass therethrough. One end of the ejection passage 25 opens at the lower surface of the cylinder head 11. Another end of the ejection passage 25 serves as a gas canister connecting portion 25*a* in communication with a gas canister 30.

The combustion-chamber frame 10 is provided in the housing 2 and is movable in the lengthwise direction of the housing 2. The uppermost end of the combustion-chamber frame 10 is abuttable on the lower surface of the cylinder head 11. The combustion-chamber frame includes a base chamber frame 10*a* and a chamber head 10*b* connected integrally using a bolt 10*c* (see FIG. 2). Since the arm section 12A is connected to the combustion-chamber frame 10, the combustion-chamber frame 10 is moved in accordance with the movement of the push lever 9. The cylinder 20 is fixed to the housing 2. An outer peripheral surface of the cylinder 20 is in sliding contact with the inner circumference of the combustion-chamber frame 10 for guiding the movement of the combustion-chamber frame 10. The cylinder 20 has an axially intermediate portion formed with an exhaust hole 21. An exhaust-gas check valve 21A is provided to selectively close the exhaust hole 21.

A piston 23 is slidably and reciprocally movably provided in the cylinder 20. The piston 23 divides an inner space of the cylinder 20 into an upper space above the piston 23 and a lower space below the piston 23. The driver blade 23*a* extends downwards from the lower surface of the piston 23 to the nose 7, so that the tip end of the driver blade 23*a* can strike against the nail (not shown). A bumper 24 made from an elastic material such as rubber is disposed at a lower side of the cylinder 20. The piston 23 strikes against the bumper 24 when the piston 23 is moved downward toward a bottom dead center.

Figure 3:
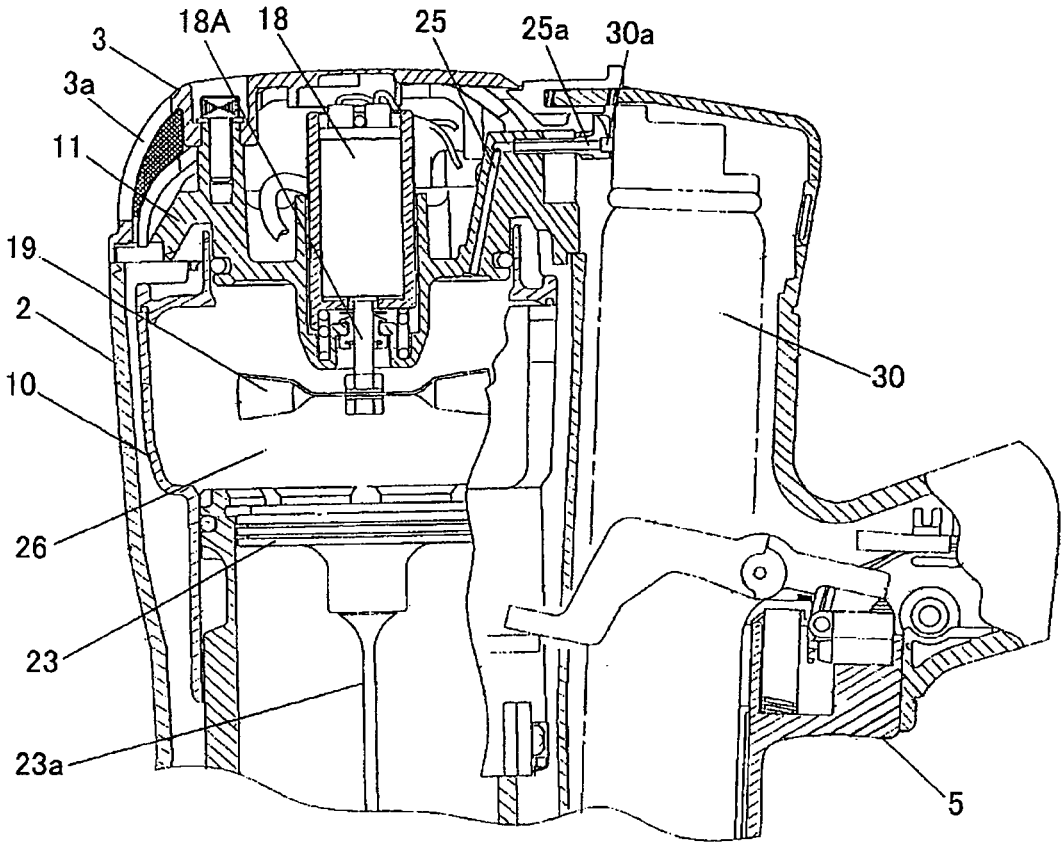
FIG. 3 is a partial enlarged diagram showing the vicinity of the combustion chamber of the combustion-type power tool and shows a state where a sealed combustion chamber is provided in the fastener driving operation.

When the upper end of the combustion-chamber frame 10 abuts the cylinder head 11, the cylinder head 11, the combustion-chamber frame 10, and the upper cylinder space above the piston 23 define a combustion chamber 26 (see FIG. 3). When the combustion-chamber frame 10 is separated from the cylinder head 11, a first flow passage 27A in communication with the atmosphere is provided between the cylinder head 11 and the upper end of the combustion-chamber frame 10, and a second flow passage 27B in communication with the first flow passage 27A is provided between the inner peripheral surface of the combustion-chamber frame 10 and the outer peripheral surface of the cylinder 20. The housing 2 has a lower portion formed with an exhaust port 2*a*. The first and second flow passages 27A and 27B allow a combustion gas and a fresh air to pass along the outer peripheral surface of the cylinder 20 for discharging these gases through the exhaust port 2*a* of the housing 2. Further, the above-described intake port 3*a* is formed for supplying a fresh air into the combustion chamber 26, and the exhaust hole 21 discharges combustion gas generated in the combustion chamber 26.

The motor 18 has a fan shaft 18A, and a fan 19 positioned in the combustion chamber 26 is fixed to a tip end of the fan shaft 18A. Rotation of the fan 19 performs the following three functions. First, the fan 19 stirs and mixes the air with the combustible gas as long as the combustion-chamber frame 10 remains in abutment with the cylinder head 11. Second, after the mixed gas has been ignited, the fan 19 causes turbulence of the air-fuel mixture, thus promoting the turbulent combustion of the air-fuel mixture in the combustion chamber 26. Third, the fan 19 performs scavenging such that the exhaust gas in the combustion chamber 26 can be scavenged therefrom and also performs cooling of the cylinder 20 when the combustion-chamber frame 10 moves away from the cylinder head 11 and when the first and second flow passages 27A and 27B are provided.

A plurality of ribs 10A protrudes radially inwardly from the portion of the combustion chamber frame 10, the portion defining the combustion chamber 26. Each rib 10A extends in the axial direction of the combustion chamber frame 10. The ribs 10A promote stirring and mixing of the air and the combustible gas in the combustion chamber 26 in cooperation with the fan 18.

Next, operation of the combustion-type power tool 1 will be described. In the non-operational state of the combustion-type nail driver 1, the push lever 9 is biased downward by the biasing force of the compression coil spring 22, so that the push lever 9 protrudes from the lower end of the nose 7. Thus, the uppermost end of the combustion-chamber frame 10 is spaced away from the cylinder head 11 because the combustion-chamber frame 10 is in association with the push lever 9 through the arm section 8. Further, a part of the combustion-chamber frame 10 which part defines the combustion chamber 26 is also spaced apart from the top portion of the cylinder 20. Hence, the first and second flow passages 27A and 27B are provided. In this condition, the piston 23 stays at the top dead center in the cylinder 20.

With this state, if the push lever 9 is pushed onto the workpiece 28 while holding the handle 4 by a user, the push lever 9 is moved upward against the biasing force of the compression coil spring 22. At the same time, the combustion-chamber frame 10 which is connected to the push lever 9 through the connection unit 12 is also moved upward, as shown in FIG. 3, closing the first flow passage 27A and hermetically sealing the combustion chamber 26.

In accordance with the movement of the push lever 9, the gas canister 30 is tilted toward the cylinder head 11. Thus, the injection rod 30*a* of the gas canister 30 is pressed against a gas canister connecting portion 25*a* of the cylinder head 11. Therefore, the liquidized combustible gas in the gas canister 30 is ejected once from the ejection port of the fuel ejection passage 25 into the combustion chamber 26.

Further, in accordance with the movement of the push lever 9, the combustion-chamber frame 10 reaches the uppermost stroke end whereupon the switch 32 is turned ON to supply electric power to the motor 18 and start rotation of the fan 19. Rotation of the fan 19 in the combustion chamber 26 in which a hermetically sealed space is provided, stirs and mixes the ejected combustible gas with air in the combustion chamber 26.

In this state, when the trigger switch 5 provided at the handle 4 is turned ON, spark is generated at the ignition plug 50 to ignite the combustible gas. As a result of combustion, volumetric expansion of the combustion gas occurs within the combustion chamber 26 to move the piston 23 downwardly. Accordingly, the driver blade 23*a* drives the nail held in the nose 7 into the workpiece 28 until the piston 23 strikes against the bumper 24.

After the nail driving, the piston 23 strikes against the bumper 24, and the combustion gas is discharged out of the cylinder 20 through the exhaust hole 21 of the cylinder 20. When the inner space of the cylinder 20 and the combustion chamber 26 becomes the atmospheric pressure, the exhaust-gas check valve 21A is closed. Combustion gas still remaining in the cylinder 20 and the combustion chamber 26 has a high temperature at a phase immediately after the combustion. The heat is absorbed through the inner surfaces of the cylinder 20 and the combustion-chamber frame 10, and the temperature of these components is also increased. However, the absorbed heat is released to the atmosphere through the outer surfaces of the cylinder 20 and the combustion-chamber frame 10.

Combustion heat of the combustion gas is absorbed into such components as the cylinder 20, so that the combustion gas is abruptly cooled down and a volume of the combustion gas is decreased. Thus, the pressure in the sealed space in the cylinder 20 above the piston 23 further drops to less than the atmospheric pressure, creating a so-called "thermal vacuum". Accordingly, the piston 23 is moved back to the initial top dead center position.

Thereafter, the trigger switch 5 is turned OFF, and the user lifts the nail driver 1 until the push lever 9 is separated from the workpiece 28. As a result, the push lever 9 and the combustion-chamber frame 10 move downward due to the biasing force of the compression coil spring 22. In this case, the fan 19 keeps rotating for a predetermined period of time in spite of OFF state of the trigger switch 5 because of an operation of a control portion (not shown). In the state shown in FIG. 1, the first and second flow passages are provided at the upper side of the combustion-chamber frame 10, so that fresh air flows into the combustion chamber 26 through the intake port 3*a* formed in the head cover 3 and the residual gas is expelled through the exhaust port 2*a* by the rotation of the fan 19. Thus, the combustion chamber 26 is scavenged. Then, the rotation of the fan 19 is stopped to restore an initial stationary state. Thereafter, subsequent nail driving operation can be performed by repeating the above described operation process.

Figure 5:
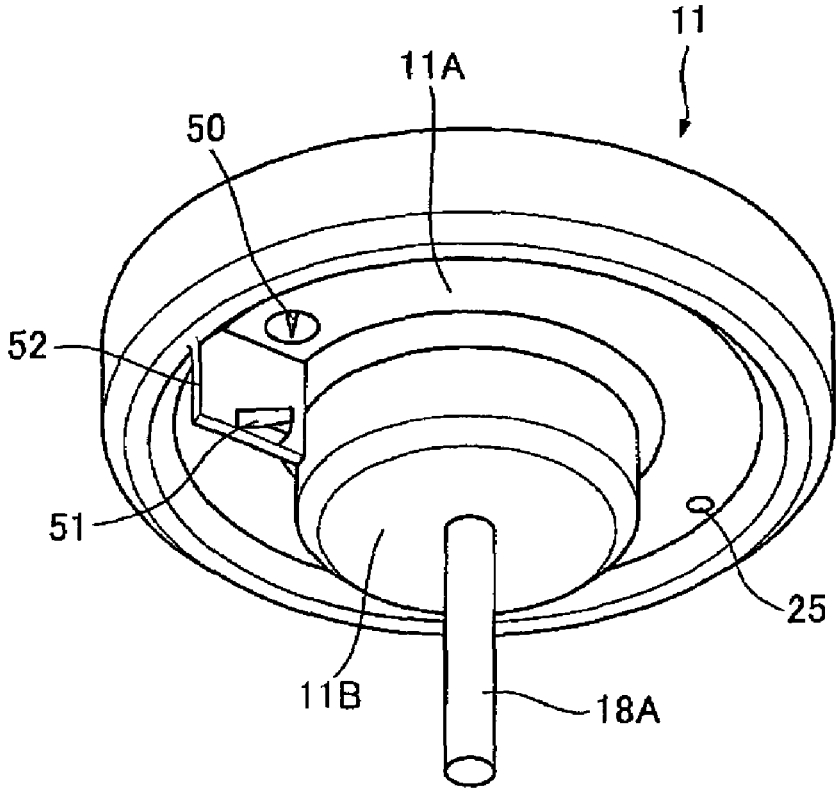
FIG. 5 is a perspective view showing the ignition arrangement in a combustion-type power tool according to a first embodiment of the present invention.
Figure 6:
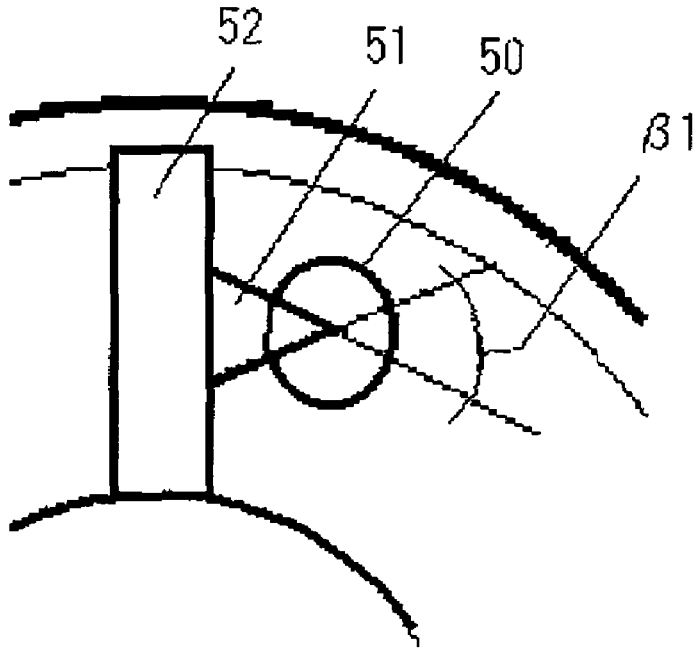
FIG. 6 is a bottom view showing the ignition arrangement in a combustion-type power tool according to a first embodiment of the present invention.

Next, an ignition arrangement including the ignition plug 50 and an ignition ground 51 will be described with reference to FIGS. 4 through 7. The ignition arrangement is provided at the cylinder head 11. FIG. 5 is a perspective view particularly showing the cylinder head 11 as viewed from a side of a combustion chamber 26, and FIG. 6 is a schematic view as viewed up from the combustion chamber 26 toward the ignition ground 51.

The ignition plug 50 is fixed to the cylinder head 11 and an ignition point is exposed to the combustion chamber 26 through one end face 11A of the cylinder head 11. The one end face 11A defines the upper end of the combustion chamber 26. The ignition plug 50 has a core 60 having a cylindrical stem portion and a tapered tip end portion. A motor boss 11B for storing the motor 18 protrudes from the one end face 11A. The motor boss 11B has an end portion from which the fan shaft 18A extends. An ignition ground holding portion 52 protrudes from the end face 11A and extends in a generally radial direction. The ignition ground 51 is attached to the ignition ground holding portion 52 at a position in confrontation with the ignition plug 50.

Generally, a spark 53 is shot between the ignition point of the ignition plug 50 and the ignition ground 51. The spark 53 is shot from an acute corner 61 of the core 60. In the first embodiment, a tip end of the core 60 has an acute angle $\theta 1$ of not more than 45 degrees (30 degrees in the illustrated embodiment). With this arrangement, an emitting point of the spark 53 can be concentrated to the tip end 61 of the core 60. The acute angle will lead to an increase in an angle at a discontinuous portion 62 at a boundary between the cylindrical stem portion and the tapered tip end portion. Thus, emission of an unwanted spark from the discontinuous portion 62 can be avoided. The unwanted spark is a spark that does not cause ignition of the air-fuel mixture.

Figure 4:
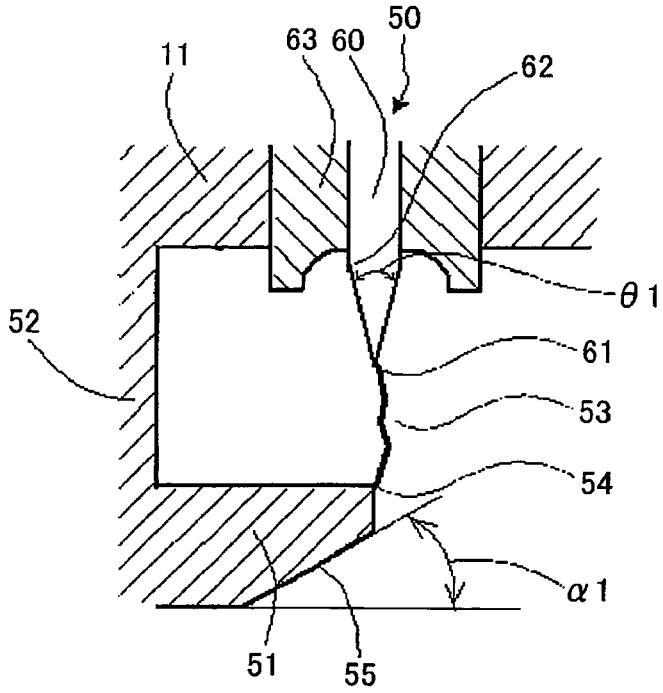
FIG. 4 is a cross-sectional view showing an ignition arrangement in a combustion-type power tool according to a first embodiment of the present invention.

In order to reduce a thermal capacity of the ignition ground 51 so as to enhance ignitability, a side 55 opposite to the spark seating face of the ignition ground 51 is tapered as shown in FIG. 4 to provide an angle $\alpha 1$. This angle is about 30 degrees in the depicted embodiment. Further, the ignition ground 51 has a triangular shape having an apex end providing an angle $\beta 1$ as shown in FIG. 6. This angle is not more than 45 degrees (about 40 degrees in the depicted embodiment). Because of the apex portion, thermal capacity of the ignition ground 51 can be reduced and an acute angle can be realized to concentrate spark receiving point at the apex portion. As a result, ignitability can be enhanced.

Figure 7:
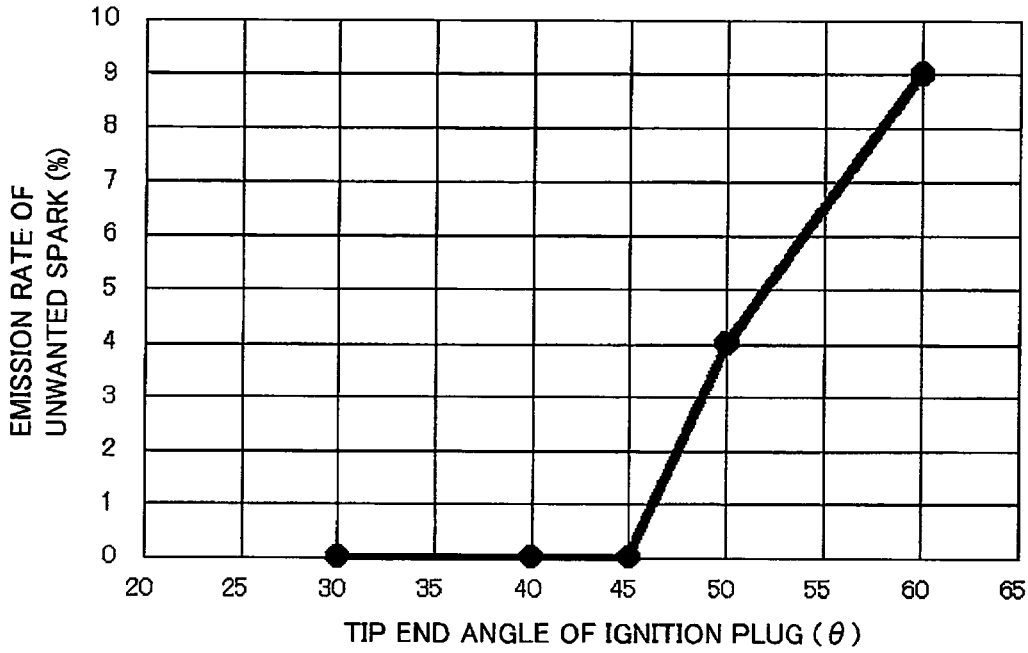
FIG. 7 is a graphical representation showing the relationship between the tip end angle θ1 and an emission rate of unwanted spark according to a first embodiment of the present invention.

FIG. 7 is a graphical representation showing the relationship between the tip end angle θ1 and an emission rate of unwanted spark. As is apparent from the graph, emission of the unwanted spark can be restrained if the tip end angle is not more than 45 degrees. Further, in accordance with the reduction of the angle of the tip end 61, a volume of the ignition plug core 60 is reduced to reduce its thermal capacity. Consequently, absorption of a heat of the ignited fire into the ignition plug from the tip end 61 can also be restrained. As a result, stabilized ignition can result.

Figure 8:
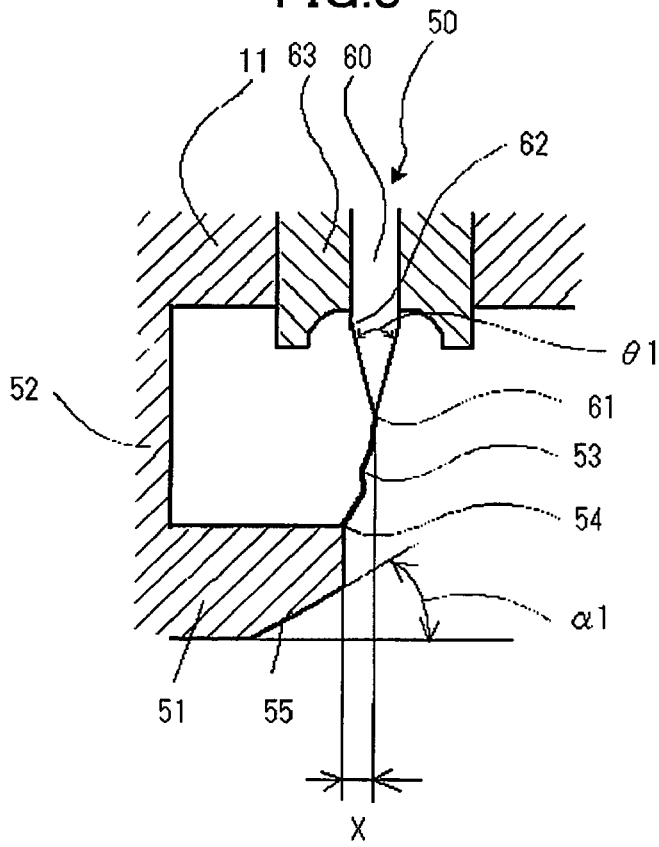
FIG. 8 is a cross-sectional view showing an ignition arrangement in a combustion-type power tool according to a second embodiment of the present invention.

FIG. 8 shows an ignition arrangement according to a second embodiment of the present invention. In the second embodiment, a line connecting the ignition point of the ignition plug 61 to an apex end of the ignition ground 54 does not extend in parallel with the axial direction of the cylinder, but these are offset from each other in a radial direction of the cylinder by an offset amount X of about 1 mm. This structure ensures a bridging of the spark 53 between the tip end portion 61 of the core 60 and the apex end 54 of the ignition ground 51.

According to the embodiments described above, heat absorption into the tip end portion of the ignition plug and into the apex end of the ignition ground can be reduced or restrained, and generation of unwanted spark can be avoided, thereby avoiding misfiring so that stabilized ignition can be realized.

Figure 9:
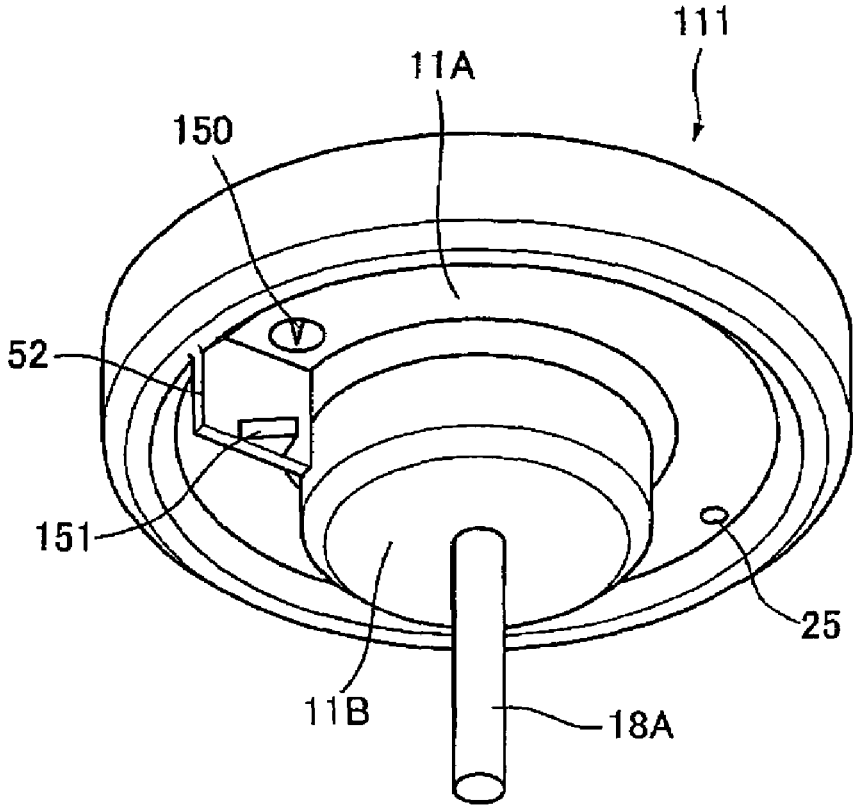
FIG. 9 is a perspective view showing an ignition arrangement in a conventional combustion-type power tool.
Figure 10:
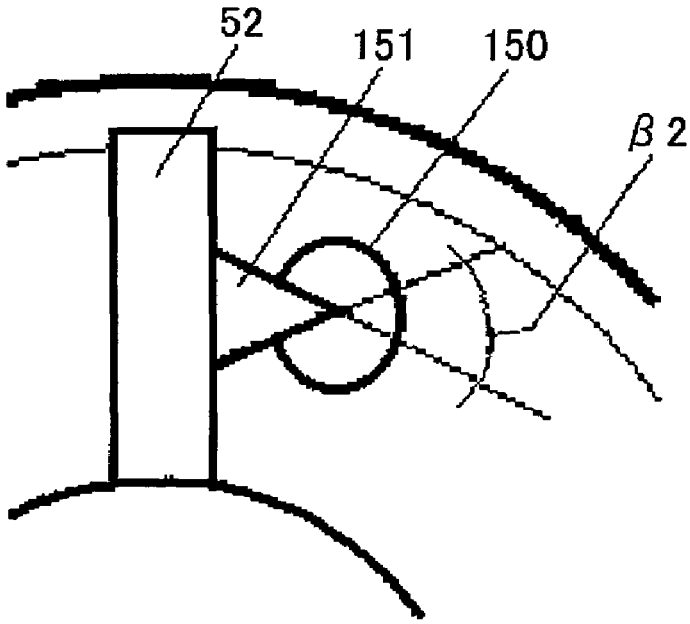
FIG. 10 is a bottom view showing the ignition arrangement in a conventional combustion-type power tool.
Figure 11:
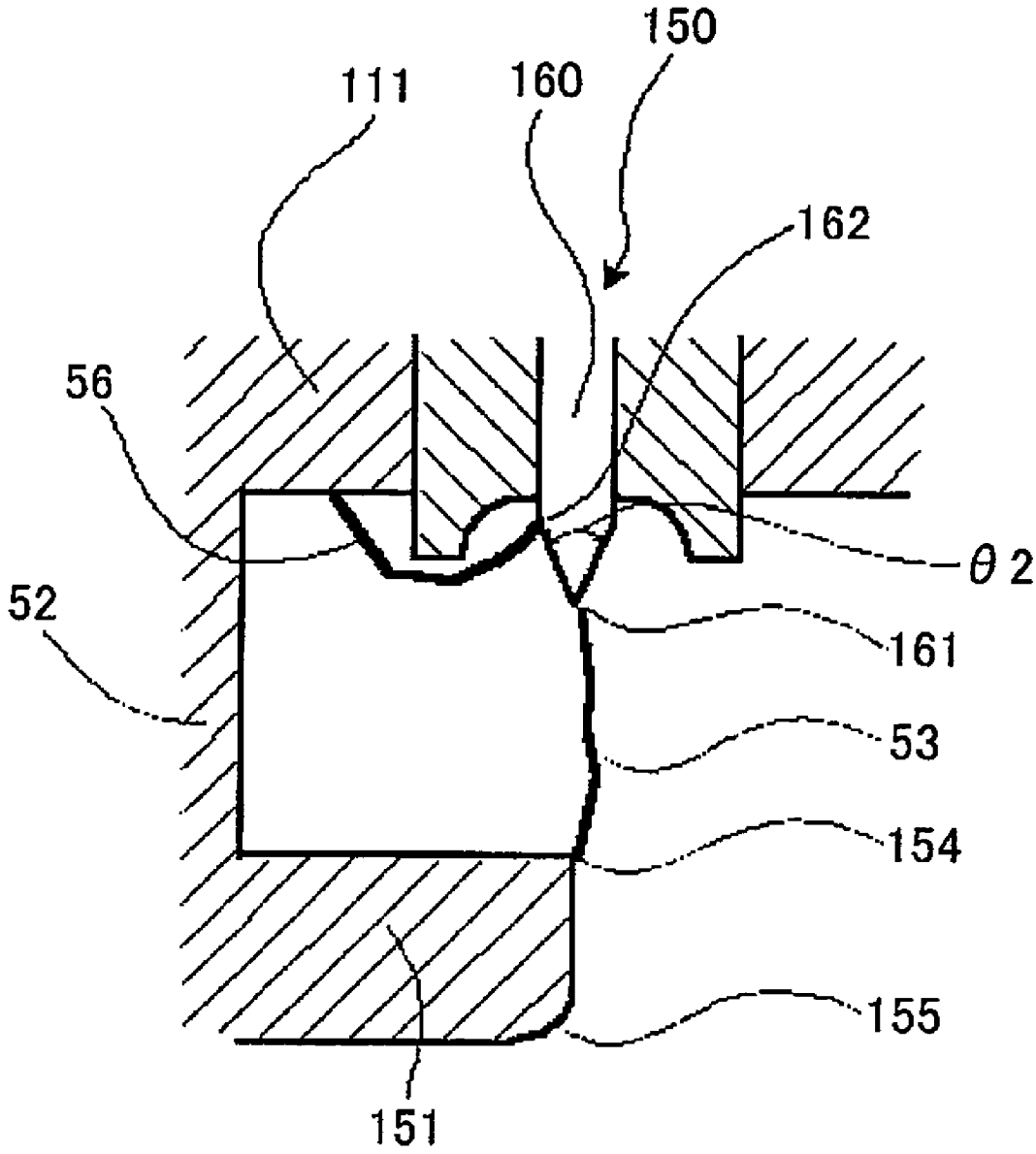
FIG. 11 is a cross-sectional view showing an ignition arrangement in a conventional combustion-type power tool.

FIGS. 9 through 11 show the conventional ignition arrangement. An angle θ2 of the tip end portion 161 of the core 160 was 60 degrees as shown in FIG. 11. In this case, unwanted spark 56 may be emitted from the angled portion 162 of the ignition core 160 toward the head cover 113. This spark 56 does not cause ignition of the air-fuel mixture. Further, as shown in FIGS. 10 and 11, the apex angle β2 at the apex portion 154 of the ignition ground 151 was in a range of from 50 to 60 degrees, and a side opposite to the spark receiving side of the ignition ground 151 extends approximately parallel thereto with a minute round portion 155. Such arrangement of the ignition ground could not sufficiently reduce its thermal capacity. Therefore, a heat of the ignited fire may be robbed by the ignition ground 151. The heat is also robbed into the ignition plug 150 due to its thermal capacity greater than that of the present embodiment.

What is claimed is:

1. A combustion-type power tool comprising:

a housing having one end;

a cylinder head disposed at the one end and formed with a fuel injection passage;

a cylinder disposed in and fixed to the housing, the cylinder defining an axial direction;

a piston slidably disposed in the cylinder and reciprocally movable in the axial direction;

a combustion chamber frame disposed in the housing and movable in the axial direction, the combustion chamber frame being abuttable on the cylinder head to provide a combustion chamber in cooperation with the cylinder head and the piston;

a fan rotatably disposed in the combustion chamber for agitating and mixing an air with a combustible gas injected into the combustion chamber through the fuel injection passage; and an ignition unit comprising an ignition plug exposed to the combustion chamber and having a tapered tip end portion providing an acute angle of less than or equal to 45 degrees, and an ignition ground disposed in opposition to the tapered tip end portion in the axial direction so as to generate a spark between the ignition plug and the ignition ground to ignite a mixture of air and the combustible gas, to thus provide a fire.

2. The combustion-type power tool as claimed in claim 1, wherein the tapered end portion extends in the axial direction the ignition ground has one side facing to the ignition plug, and another side opposite to the one side, the another side being tapered to provide an angle.

3. The combustion-type power tool as claimed in claim 2, wherein the ignition ground has a triangular shape having an apex end providing an angle being less than or equal to 45 degrees.

4. The combustion-type power tool as claimed in claim 1, wherein the cylinder defines a radial direction, the ignition ground having a triangular shape having an apex end providing an angle, the tip end of the ignition plug having an ignition point, a first imaginary line extending from the ignition point in the axial direction of the cylinder, a second imaginary line extending from the apex end in the axial direction of the piston, the first imaginary line and the second imaginary line being offset from each other in the radial direction of the cylinder.

5. An ignition arrangement in a combustion type power tool in which a fan is provided in a combustion chamber defined by a cylinder head, a movable combustion chamber frame, a cylinder and a piston, a motive power of the piston being generated upon combustion of a mixture of air and a combustible gas in the combustion chamber, the arrangement comprising:

an ignition plug exposed to the combustion chamber and having a tapered tip end portion extending in an axial direction providing an acute angle of less than or equal to 45 degrees; and an ignition ground disposed in the combustion chamber in opposition to the tapered end portion in the axial direction and generating a spark between the ignition plug and the ignition ground to ignite the mixture to thus provide a fire.

6. The ignition arrangement in a combustion type power tool as claimed in claim 5, wherein the ignition ground has one side facing to the ignition plug, and another side opposite to the one side, the another side being tapered to provide an angle.

7. The ignition arrangement in a combustion type power tool as claimed in claim 6, wherein the ignition ground has a triangular shape having an apex end providing an angle being less than or equal to 45 degrees.

8. The ignition arrangement in a combustion type power tool as claimed in claim 5, wherein the cylinder defines a radial direction and an axial direction, the ignition ground having a triangular shape having an apex end providing an angle, the tip end of the ignition plug having an ignition point, a first imaginary line extending from the ignition point in the axial direction of the cylinder, a second imaginary line extending from the apex end in the axial direction of the piston, the first imaginary line and the second imaginary line being offset from each other in the radial direction of the cylinder.

9. A combustion-type power tool comprising:

a housing defining an outer frame;

a combustion chamber provided in the housing;

an ignition unit comprising an ignition plug exposed to the combustion chamber and having a tapered tip end portion extending in an axial direction providing an acute angle of less than or equal to 45 degrees, and an ignition ground which is separate from the ignition plug disposed in opposition to the tapered end portion in the axial direction.

10. The combustion-type power tool as claimed in claim 9, wherein the ignition ground has one side facing to the ignition plug, and another side opposite to the one side, the another side being tapered to provide an angle.

11. The combustion-type power tool as claimed in claim 10, wherein the ignition ground has a triangular shape having an apex end providing an angle being less than or equal to 45 degrees.

12. The combustion-type power tool as claimed in claim 9, wherein the ignition ground has a triangular shape having an apex end providing an angle being less than or equal to 45 degrees.

13. The combustion-type power tool according to claim 1, wherein the ignition plug and the ignition ground are separate members which are spaced from one another.

14. The combustion-type power tool according to claim 13, wherein the ignition ground is held on an ignition ground holding member which protrudes from an upper end face of the combustion chamber and extends in a radial direction of the combustion chamber.

15. The ignition arrangement in a combustion type power tool according to claim 5, wherein the ignition ground is held on an ignition ground holding member which protrudes from an upper end face of the combustion chamber and extends in a radial direction of the combustion chamber.

16. The combustion-type power tool as claimed in claim 9, wherein the ignition ground is held on an ignition ground holding member which protrudes from an upper face of the combustion chamber and extends in a radial direction of the combustion chamber.

17. A combustion-type power tool comprising:

a housing;

a cylinder head disposed at an end of the housing;

a cylinder disposed in the housing, the cylinder defining an axial direction;

a piston slidably disposed in the cylinder;

a combustion chamber frame movably disposed in the housing to provide a combustion chamber; and an ignition unit comprising an ignition plug exposed to the combustion chamber and an ignition ground plate;

wherein the ignition ground plate extend in a direction perpendicular to the axial direction and spaced from the ignition plug in the axial direction, said ignition ground plate having a tapered tip end portion providing an acute angle of no greater than 45 degrees.

18. The combustion-type power tool as claimed in claim 17, wherein the ignition ground plate has a first surface facing toward the ignition plug and a second surface facing away from the ignition plug, the second surface being tapered to form a thin end portion of the ignition ground plate.

19. The combustion-type power tool as claimed in claim 17, wherein the ignition plug has a tapered end portion.

20. The combustion-type power tool as claimed in claim 19, wherein the ignition plug has the tapered end portion having an acute angle of no greater than 45 degrees.

21. The combustion-type power tool as claimed in claim 19, wherein an edge of the tapered end portion of the ignition plug and an edge of the tapered tip end portion of the ignition ground plate are offset from each other in a radial direction of the cylinder.

* * * * *